US006290516B1

(12) United States Patent
Gerber

(10) Patent No.: US 6,290,516 B1
(45) Date of Patent: Sep. 18, 2001

(54) CONDUCTOR BAR

(75) Inventor: André Gerber, Thun (CH)

(73) Assignee: USM U. Scharer Sohne AG, Munsingen (CH)

( * ) Notice: Subject to any disclaimer, the term of this patent is extended or adjusted under 35 U.S.C. 154(b) by 0 days.

(21) Appl. No.: 09/355,838

(22) PCT Filed: Feb. 26, 1998

(86) PCT No.: PCT/CH98/00081

§ 371 Date: Aug. 5, 1999

§ 102(e) Date: Aug. 5, 1999

(87) PCT Pub. No.: WO98/38705

PCT Pub. Date: Sep. 3, 1998

(30) Foreign Application Priority Data

Feb. 27, 1997 (CH) ..... 457/97

(51) Int. Cl.[7] ..... H01R 13/648; H01R 4/66; H01R 25/00; H01R 4/60

(52) U.S. Cl. ..... 439/110; 439/94; 439/121; 439/209; 439/216

(58) Field of Search ..... 439/94, 110, 116, 439/117, 118, 120, 121, 209, 207, 211, 212, 214, 215, 216

(56) References Cited

U.S. PATENT DOCUMENTS 3,753,209 * 8/1973 Hesse ..... 439/117
3,933,403 * 1/1976 Rubesamen et al. ..... 339/22

FOREIGN PATENT DOCUMENTS

| | | |
|---|---|---|
| 839438 | 7/1976 | (BE) . |
| 2002419 | 9/1970 | (DE) . |
| 3924045 | 1/1991 | (DE) . |
| 4042395 | 2/1992 | (DE) . |
| 4302560 | 4/1994 | (DE) . |
| 517318 | 2/1940 | (GB) . |
| 2026258 | 1/1980 | (GB) . |
| 9633532 | 10/1996 | (WO) . |

* cited by examiner

*Primary Examiner*—Paula Bradley
*Assistant Examiner*—Edwin A. León

(57) ABSTRACT

A conductor rail, in particular for the electrification of furniture, has a section member (1) with a longitudinal channel (3.2) in which there are arranged at least two leads (9.1, 9.2) foreseen for the current supply. The longitudinal channel (3.2) is accessible via a longitudinal slot (4.2) in the section member (1) in order to be able to contact the leads (9.1, 9.2) with a plug at any location. The mentioned at least two leads (9.1, 9.2) are arranged sunk in the same lateral wall (5.1) of the longitudinal channel (3.2). The plug is characterised by a snout (16) which can be introduced into the longitudinal slot (4.2), with at least two laterally protruding contact elements (22.1, 22.2) which are formed for contacting the leads (9.1, 9.2) of the conductor rail.

20 Claims, 5 Drawing Sheets

Fig. 5a
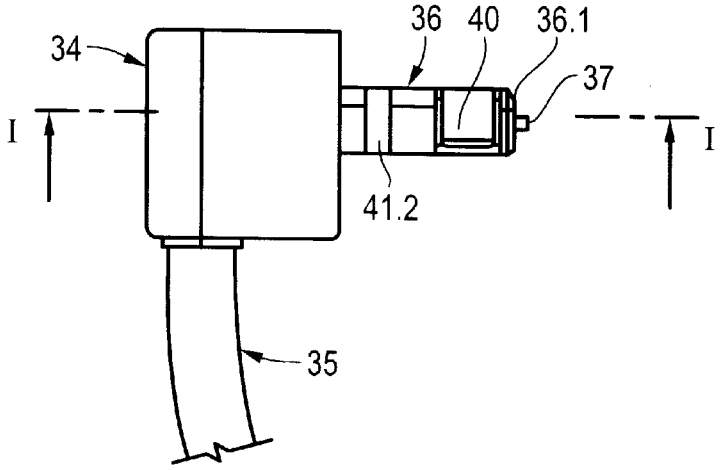
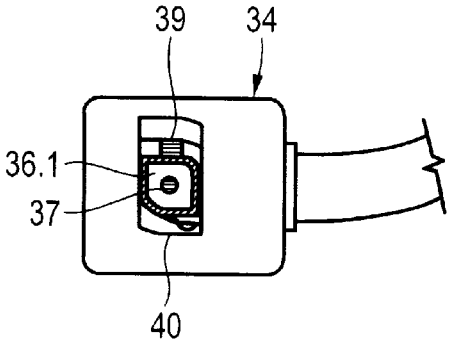
Fig. 5b
Fig. 5c
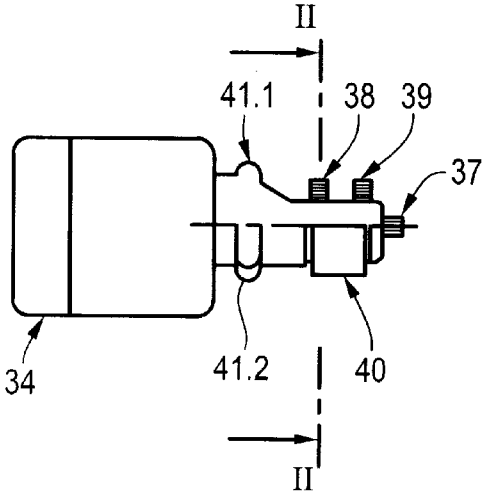

(A-A)

CONDUCTOR BAR

This application is the national phase under 35 U.S.C. §371 of PCT International Application No. PCT/CH98/00081 which has an International filing date of Feb. 26, 1998 which designated the United States of America.

FIELD OF THE INVENTION

The invention relates to a conductor rail, in particular for the electrification of furniture, with a section member with a longitudinal channel in which there are arranged at least two leads foreseen for the leading of current and which is accessible via a longitudinal slot in the section member in order to be able to contact the leads at any location with a plug. Furthermore the invention relates to a plug in order to be able to tap the conductor rail at any location.

DESCRIPTION OF RELATED ART

Nowadays almost every workplace in the office region is equipped with a computer. Also telephones are commonly no longer operated from the current of the telephone connection alone, they must be connected to the electricity network like any other electrical apparatus. Finally for satisfying the individual lighting requirements (that is to say in offices with several workplaces) often an additional table or standing lamp is employed.

Conventionally, an extension cable with a plug socket is laid on the floor, to which the various consumers are directly connected. According to experience this leads to a confusion of cables, which is not satisfactory either for reasons of technical security or aesthetics. (Similar problems occur also e.g. in laboratory regions and in the home.)

It is of course known per se that the electrification becomes much more comfortable when using conductor rails. In DE 40 42 395 A1 there is described by way of example a conductor rail which may be mounted at an angle between two wall surfaces. The electrical leads are embedded into an insulation section which is accommodated in a housing (aluminium section). However the housing is triangular in cross section and as a whole extremely large.

DE 39 24 045 A1 shows a conductor rail with a plug for a lighting body. The conductor rail is formed by a U-shaped section of rubber or plastic. In the insertion cavity which is arranged on a narrow side of the section cross section which is essentially rectangular in cross section, there are accommodated two electrical leads. They are located at the inner sides of the cavity which lie opposite one another. On insertion of the plug this is clamped between the two leads. By way of a rib/flute design the plug is retained in its position.

The largest part of the known conductor rails is foreseen for installation in buildings. Those to be mentioned are conductor rails for lighting and those for placing sockets at freely selectable locations. These arrangements satisfy the applicable safety standards, but are very large. Besides these, conductor rail systems for special applications are known (cf. e.g. DE 39 24 045 A1) which however are mostly not satisfactory with regard to safety.

SUMMARY OF THE INVENTION

It is the object of the invention to specify a conductor rail of the initially mentioned type which is very compact and is suitable for the electrification of furniture.

The solution of this object is defined by the features of claim 1. According to the invention all leads responsible for conducting the current are arranged sunk in the same lateral wall of the channel.

In this way it is ensured that an object of any type introduced into the channel cannot contact the electrical leads without further ado. (If one of the two leads were at the rear side of the channel then with a straight rod it could easily be contacted, this even being when the lead is sunk.

The measure put forward however also permits a flat and compact design of the section member. The electrical leads are indeed to be arranged at a certain distance from one another for safety reasons. The size of this distance, with the chosen design, does not effect the height, but at the most the width of the section cross section. Finally, also the height may be kept to a minimum in that the two leads are arranged next to one another and not opposite one another. In any case it is indeed necessary that the insulation material which must surround the leads has a certain dimension. With the invention this dimension does not doubly effect the height of the sectioned cross section but only once.

For the electrification of furniture (e.g. desks or general furniture systems) it is desirable that the section member is formed very flat and that the longitudinal slot is arranged on a narrow side of the typically rectangular section. By way of this, on the one hand there results a slim and elegant presentation and on the other hand the possibility of inconspicuously fastening the conductor rail to the lower side of the table surface (without losing substantial leg freedom).

Preferably the current conducting leads are embedded into an insulating member. With this it is the case e.g. of a strip-shaped insert of plastic with several deepenings for the leads. According to the invention the insert is placed on the lateral wall of the longitudinal channel. The insert is kept as thin as possible and may be just as wide as the lateral wall. It may be fixed in the channel with a positive fit or a frictional fit.

The section member may be of metal (steel, aluminium etc.) so that it may be applied as a carrying element of a piece of furniture. This means that with a table, a rolling body, a mobile separating wall or likewise, a leg (or a vertical or horizontal member) may be formed in the manner of the conductor rail according to the invention.

It is however also conceivable that the structured member consists of a non-conducting material (e.g. of a plastic) and that only a suitable metallic earth is mounted in the longitudinal channel.

In order to constantly ensure a good pressure contact with the plug, the electrical leads should be spring mounted. In this context the member may be manufactured of an elastic material. If for certain reasons a non-elastic material is to be used, then the structure of the member is to be created such that there results a spring mounting of the leads (grid or honeycomb structure).

According to a preferred embodiment form, the contact pins of the plug are pressed with a spring force onto the leads of the conductor rail. For this purpose a spring element with a suitable effect may be provided on the plug.

The member with the embedded strip leads may be inserted from the end face of the metal section.

With a section member which is preferably applied, the channel has a cross section which tapers towards the inside from the side of the longitudinal slot. With this the section member may comprise two similar longitudinal channels (in a symmetrical arrangement).

Preferably the side lying directly opposite the longitudinal slot (the rear side of the channel, the rear wall or the displaced forward intermediate wall) is formed of metal. If for the current conducting leads there is provided an insulating member, then on the mentioned rear wall of the free inner space a third lead may be installed as earth. If the plug is introduced into the longitudinal channel, then firstly the mentioned earth lead is touched before contact can be made with the current conducting leads.

Another possibility for earthing lies in the fact that the second lateral wall which lies opposite the first lateral wall equipped with the leads is metallic, in order to be contacted by the plug for the purpose of earthing. It is simplest when the section member consists of metal and the mentioned lateral wall is free of an insulating covering layer (coating or likewise). With a plastic section, a metal coating may be attached at the mentioned location.

Directly next to or behind the longitudinal slot, according to a preferred embodiment form of the invention, there are provided ribs or flutes which serve the retention or locking. The plug therefore also has a shoulder (or a collar or likewise) which may be brought into engagement with the ribs or flutes.

The conductor rail has at its disposal a rigidly mounted connection element for the supply of current. This may not be displaced by the user. The connection element is namely designed for currents which are somewhat higher than those which may be tapped by a plug at any location. It is therefore very important that the electrical contact between the leads of the conductor rail and the contact connections is ensured without any problem whatsoever. (The conductor rail according to the invention is e.g. designed for 10A or 16A. The connection element in a test must withstand considerably higher currents.).

Per conductor rail there may of course only be one single current supply present, there will however probably be incorporated several tap capable of power. (A tap capable of power is to be understood as one which is designed for the same power as the supply). The connection element may be designed as a tap as well as also a supply. In particular both functions may be present in the same element. In this manner several conductor rails may be connected among one another (in series connection).

Preferably the connection element is arranged sunk in the channel. This means that it is so small that it does not protrude out of the longitudinal slot. This is then as a matter of fact of importance when there are provided as standard several connection elements (formed as taps). The taps which are not needed may then be hidden with a cover strip inserted into the longitudinal slot.

If the section member and as a result the free space available in the longitudinal channel are kept small in cross section, then under certain circumstances it is necessary to arrange certain parts of the connection element (e.g. a plug jack, fuse element or likewise) outside of the channel. With overloads lasting a short time, leads with too small a surface may lead to damages. It is therefore important that the electrical elements of the arrangement are adequately large even with specially cramped conditions. The geometry of an arrangement with a given electrical power cannot be minaturised in any manner.

As a rule the installed conductor rail according to the invention will only comprise one connection element (which is also of advantage for reasons of technical safety). The connection element is otherwise typically integrated at the end of the conductor rail.

For earthing the metallic section member, the corresponding lead of the channel (e.g. with a soldered flex) is connected to a screw penetrating the wall of the section member, with a sectioned lock washer (whose tips or spikes penetrate into the surface of the section member).

The connection element may have spike elements at its disposal, which on assembly are driven into the section member. In this way not only can an anchoring, but also a protective earthing of the element may be realised.

The plug with which the conductor rail according to the invention can be tapped at any location is characterised by a snout which can be introduced into the longitudinal slot, with at least two contact elements laterally protruding in the same direction. These contact elements protrude so heavily that they can contact the leads embedded in the deepening. It is the case e.g. of pins which can be brought into contact with the leads on rotation of the plug. (As with the bit of a key on rotating into the lock, so do the contact elements on rotation sink into the deepenings of the leads).

According to a preferred embodiment form of the invention, at the tip of the snout there is provided an electrically conducting element for the purpose of earthing. On introducing the plug into the longitudinal channel, the element contacts the lead provided on the rear wall of the longitudinal channel. Advantageously the mentioned earthing element forms a spring contact (e.g. in the manner of a pin spring-mounted in the axial direction in the plug). In this manner e.g. manufacturing tolerances may be accommodated. Furthermore in combination with the current tapping contact elements projecting perpendicularly to the spring path, there results an improved retention or fixing of the plug in the conductor rail.

Another possibility lies in providing a contact element for the earth on the rear side of the snout (i.e. on the side distant to the protruding contact elements). This contact element contacts the earthed lateral wall of the channel, which lies opposite the leads.

The snout is adapted to the free, inner cross section of the channel. According to a preferred embodiment form of the current rail, the snout is therefore tapered towards the tip. It may however also be cylindrical in sections.

In order to be able to retain the plug, at the rear end of the snout there is formed e.g. a collar (a shoulder, a deepening or likewise) which by rotating the plug can be brought into engagement with a shoulder (rib) or deepening (flute) present in the channel (next to or behind the longitudinal slot).

Due to safety considerations it is desirable if the power which can be accommodated by the plug according to the invention can be limited. So that the plug itself does not need to be enlarged, a cable coupling (i.e. a cable piece with a male and a female plug) may be provided, on one end of which the mentioned plug introducable into the conductor rail is mounted and on whose other end a plug with an integrated fuse (e.g. melting fuse) is mounted.

The conductor rail according to the invention is in no way limited to application with furniture. It may e.g. also be used to make available a continuous current tapping on the wall of a room (e.g. in the manner of a skirting-board).

From the subsequent detailed description and the entirety of the patent claims there result further advantageous embodiment forms and feature combinations of the invention.

BRIEF DESCRIPTION OF THE DRAWINGS

The drawings used for explaining the embodiment example show:

FIGS. 5*a–c* a schematic representation of a plug with an earth contact at the tip;

Basically in the figures the same parts are given the same reference numerals.

DETAILED DESCRIPTION OF THE INVENTION

Figure 1:
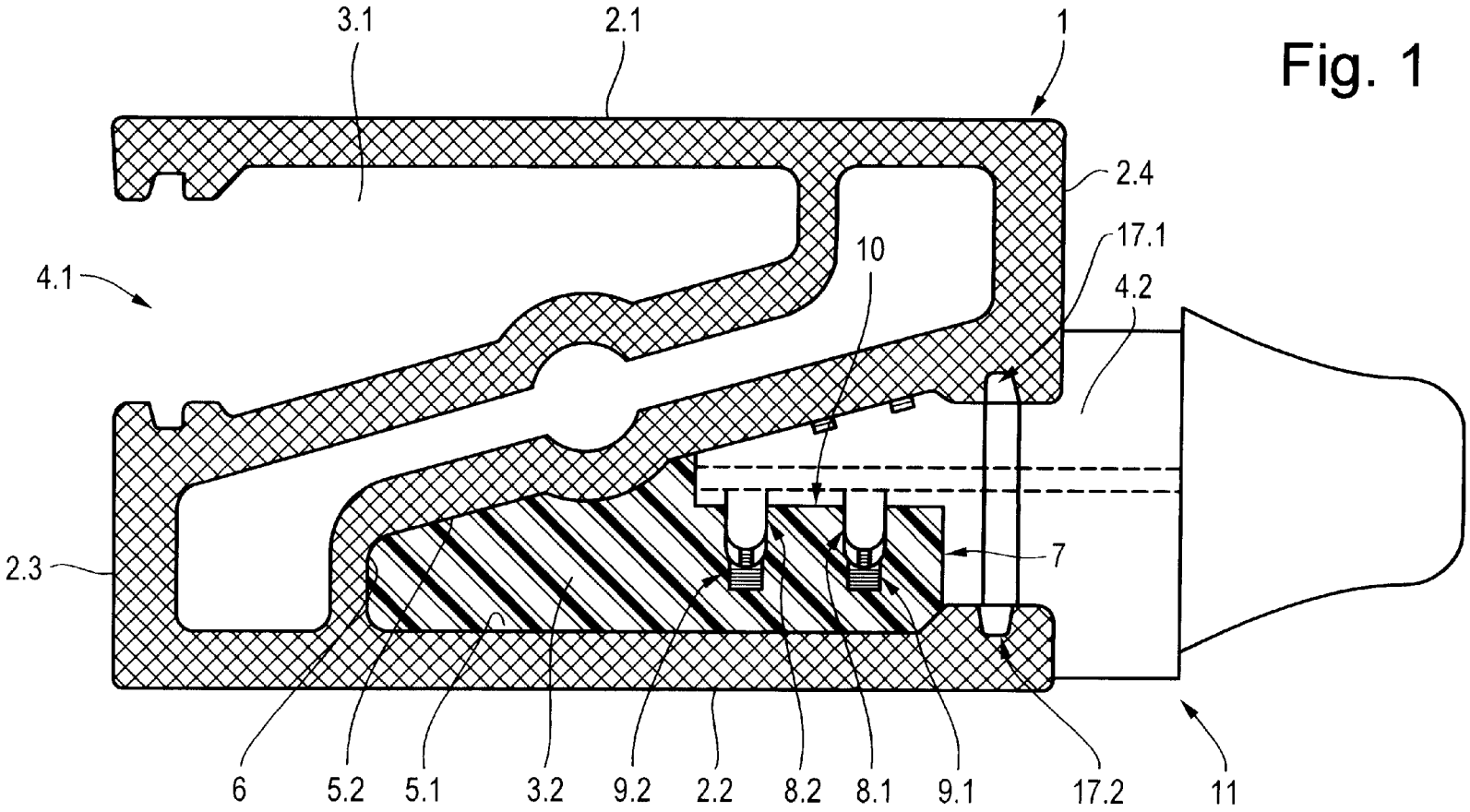
FIG. 1 a schematic representation of a cross section of a current rail with a plug.

FIG. 1 shows a preferred form of a section member 1 in cross section. This consists preferably of aluminium and is essentially rectangular, wherein there are formed two wide and two narrow outer sides 2.1 and 2.2, 2.3 and 2.4 respectively. The ratio of the wide to the narrow side may e.g. be 2:1. (The outer sides 2.1 and 2.2 are e.g. about 5 cm and the outer sides 2.3 and 2.4 about 3 cm wide).

In the section member 1 there run two longitudinal channels 3.1, 3.2 which in each case are accessible through a longitudinal slot 4.1 and 4.2 respectively. The longitudinal slots 4.1 and 4.2 are located in the narrow outer sides 2.3 and 2.4 (and have in the present example a width of about 1 cm). Since the illustrated section member 1 is symmetrical in cross section (this being with respect to a 180° rotation about the longitudinal middle axis) in the following only one of the two longitudinal channels 3.1, 3.2 is described. This even further proves the fact that it is not at all essential that two longitudinal channels are present. The symmetry of the sectional cross section is of just as little importance.

The longitudinal channel 3.2 tapers from the longitudinal slot 4.2 towards the rear to the rear wall 6. In the longitudinal channel 3.2 there can be identified two lateral walls 5.1, 5.2. The one is "straight" whilst the other is "oblique" (since it is inclined with respect to the outer side 2.1).

In the longitudinal channel 3.2 there is placed a member 7 of insulating material (in particular of a suitable plastic). Essentially this is the case of a strip whose outer contours are adapted as much as is required to the contours of the longitudinal channel 3.2. In the present example the "straight" lateral wall 5.1 is completely covered. The oblique lateral wall 5.2 on the other hand is only contacted about up to half the depth of the longitudinal channel 3.2. In the present embodiment example the rear part (in cross section) of the longitudinal channel 3.2 is completely filled out by the member 7. In the front part however between the surface 10 of the member and the lateral wall 5.2 there is formed a free space accessible through the longitudinal slot 4.2.

In the surface 10 (which in the present example lies parallel to the lateral wall 5.1 and is located approximately in the middle of the width of the longitudinal slot 4.2) there are provided two deepenings 8.1, 8.2 into which the current conducting leads 9.1, 9.2 are laid. The deepenings 8.1, 8.2 are formed as narrow longitudinal slots (in the direction of the longitudinal axis of the section member 1) and have a depth which is larger than the width (e.g. twice as large).

The member 7 is formed such that the leads 9.1, 9.2 are mounted slightly sprung. In this manner a good mechanical pressure contact can be guaranteed. The required elasticity can e.g. be achieved in that the member 7 in the region of the deepenings 8.1, 8.2 forms small bridges, i.e. that here the member does not lay on the lateral wall 5.1.

From the details described up to know there results the following: if one defines the introduction direction as that direction in which a plug is to be inserted through the longitudinal slot 4.2 into the longitudinal channel 3.2 (i.e. therefore in a direction perpendicular to the outer wall 2.4), then the deepenings 8.1, 8.2 are formed perpendicular to the introduction direction. According to the invention the placing of the deepenings 8.1, 8.2 as well as their width and depth with respect to the longitudinal slot 4.2 are chosen such that it is not possible with a straight pin or rod to touch the current conducting leads 9.1, 9.2. (The closer the deepenings 8.2, 8.2 to the longitudinal slot 4.2, the larger must be their depth. Likewise it is of importance where the surface 10 is arranged with respect to the two edges of the longitudinal slot 4.2). The lateral wall 5.2 is electrically conducting so that the section member 1 may serve as an earth lead.

The described conductor rail may be contacted at any location with the plug 11 allusively shown in FIG. 1. In the following then, the plug 11 (which is not a common standardised plug) is to be shown in detail by way of FIGS. 2*a–c*.

The rear end of the plug 11 is formed as a grip 12. So that it may be easily grasped and rotated with force, it is not round in cross section, but rectangular or oval.

At the front on the grip 12 there is formed a cylindrical section 13. Its diameter is larger than the width of the longitudinal slot 4.2. Then there follows a second cylindrical section 14 whose diameter is roughly the same size or slightly smaller than the width of the longitudinal slot 4.2. This section 14 is foreseen for being introduced into the longitudinal slot 4.2. Between the two sections 13 and 14 there is formed a shoulder 15 which on introduction of the plug 11 into the longitudinal channel 3.2 bears on the outer side 2.4.

On the section 14 there sits a collar 16. This is not cylindrical, but is formed ovally. As can be particularly recognised from FIG. 2*c*, the small transverse dimension is the same size as the diameter of the section 14 (cf. also FIG. 2*a*), the large transverse dimension on the other hand exceeds the mentioned diameter).

As can be seen from FIG. 1, the collar 16 is provided for engaging into the flutes 17.1, 17.2 (which are formed at the edge of the longitudinal slot 4.2). The plug 11 may also be retained in the section member 1 by rotation about e.g. 900.

The front end of the plug 11 is formed by a snout 18. This is asymmetrical and has e.g. the shape of a quarter of a truncated cone. The rear side 19 of the snout 18 is thus curved in the manner of a conical surface, whereas the front side 20 is essentially straight or flat.

On the front side 20 there are formed two parallel pegs 21.1, 21.2 with contact elements 22.1, 22.2. They stand perpendicular to the longitudinal axis of the plug and have a length which corresponds to the depth of the deepenings 8.1, 8.2. As can be seen from FIG. 1, the pegs 21.1, 21.2, with an inserted plug 11, engage into the deepenings 8.1,8.2 in order to contact the current conducting leads 9.1, 9.2.

On the rear side 19 of the snout 18 there are located two further contact elements 23.1, 23.2. They contact the metallic lateral wall 5.2 in order to ensure the earthing. By way of the rotation of the plug 11 described further above, the contact elements 23.1, 23.2 rub on the lateral wall 5.2, wherein dirt and small oxidations on the metallic surface are advantageously broken through or scratched away.

Figure 2A:
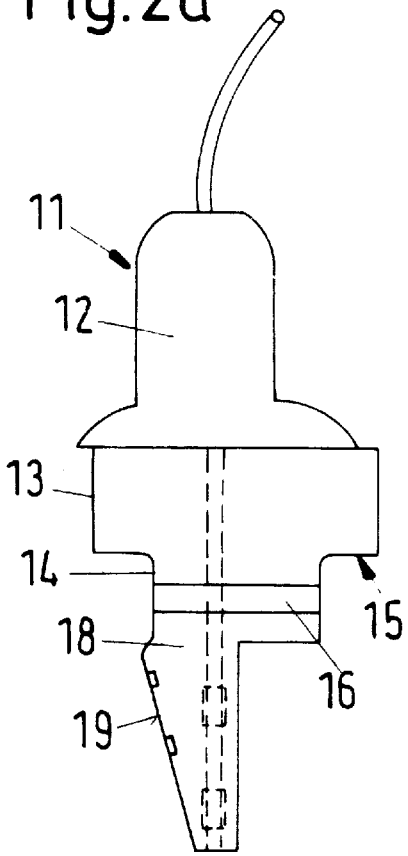
FIGS. 2*a–c* a schematic representation of a plug in two different lateral views and a front view.
Figure 2B:
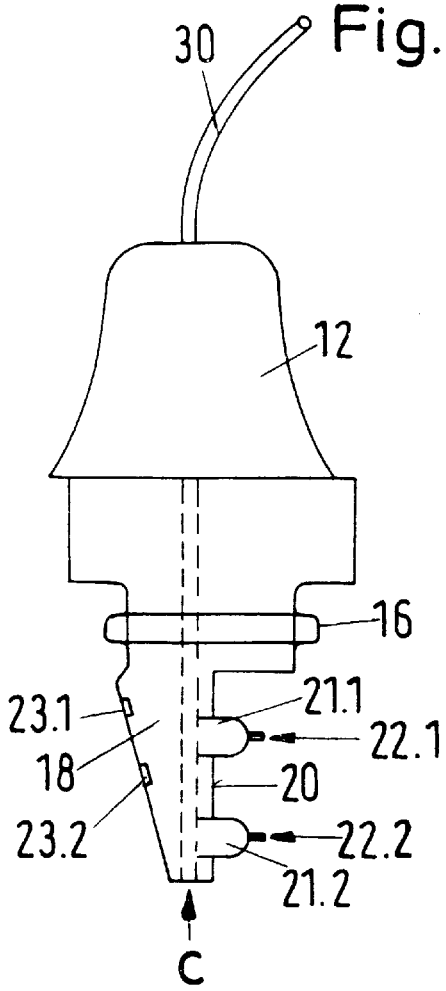
Figure 2C:
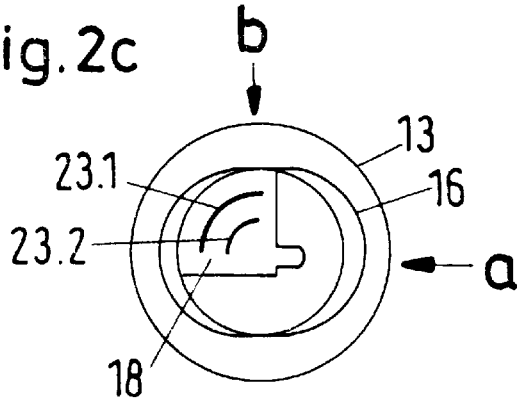

The plug shown in FIGS. 2*a–c* is extremely small and is not designed for large powers. It however is indeed sufficient when the usual users such as lamps, table computers etc. can be supplied. In order to ensure that no currents flow which are too high, a melting fuse of e.g. 2 A may be provided. Since the plug 11 itself is as a rule too small for the installation of such a fuse, at the other end of the cable 30 a larger coupling plug may be welded on which contains the mentioned fuse. (The coupling plug is advantageously formed as a DIN standard or ISO standard coupling piece).

Figure 3:
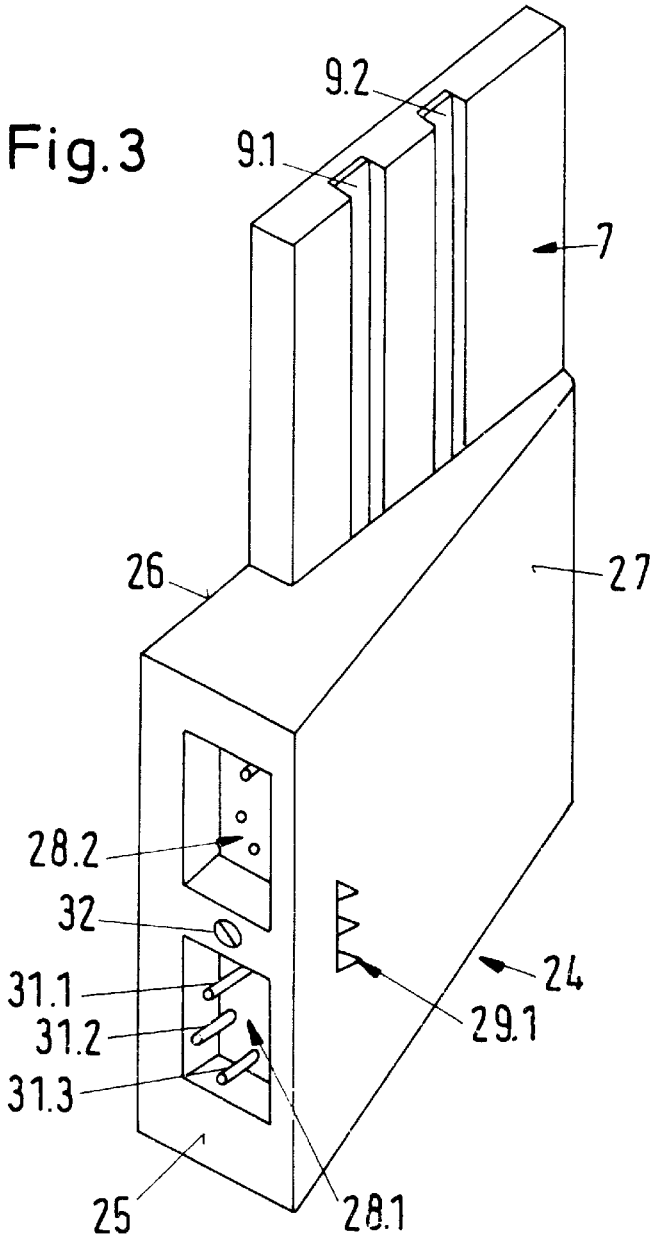
FIG. 3 a schematic perspective representation of a connection element.

The supply of the whole current or the tapping of larger powers (e.g. up to 16A with 230V) is effected via a rigidly installed connection element 24, as is for example shown in FIG. 3. It has a housing which completely finds place in the longitudinal channel 3.2. Advantageously it does not protrude out of the longitudinal slot 4.2. The member 7 and the housing may consist of one continuous block.

Corresponding to the cross sectional shape of the longitudinal channel 3.2, the housing tapers from the front side 25 towards the rear. The housing is so assembled in the longitudinal channel 3.2 that the lower side 26 bears on the lateral wall 5.1 and the upper side 27 on the lateral wall 5.2. (The front side 25 will roughly lie in the region of the flutes 17.1, 17.2).

At the front side 25, there are e.g. provided two connections 28.1, 28.2 arranged deepened. In the present example the connection 28.1 (male) has available three pins 31.1, 31.2, 31.3 for a corresponding plug for the current supply. The connection 28.2 is female and correspondingly serves for tapping larger powers. Several conductor rails are able to be connected to one another via a coupling cable on account of the two mentioned connections 28.1, 28.2. This is e.g. advantageous when several pieces of furniture equipped with conductor rails according to the invention stand next to one another.

In the connection element 24 there may be incorporated a fuse which limits the supplied current. Furthermore it may be of advantage to integrate a filter against disturbances and overvoltages in the feed block.

The pins 31.1, 31.2, 31.3 may be removably mounted. Behind this lays the consideration that per conductor rail—independently of how many connection elements are mounted—always only a single set of pins is supplied, so that without further ado it is not possible to create more than one supply per conductor rail.

As can be further recognised from FIG. 3, the member 7 is recessed in the connection element 14 (i.e. to be precise in the lower side 26 thereof). The electrical leads 9.1, 9.2 are electrically connected (e.g. by wires) to the associated pins (more exactly to the pins 31.1 and 31.3) or jacks. For the fixation and the protective earthing of the section member 1, on the upper and lower side 27 or 26 respectively, there are provided spike elements 29.1, 29.2 (cf. FIG. 4). These may be driven into the corresponding lateral walls 5.2 or 5.1 respectively with the help of a screw 32.

Figure 4:
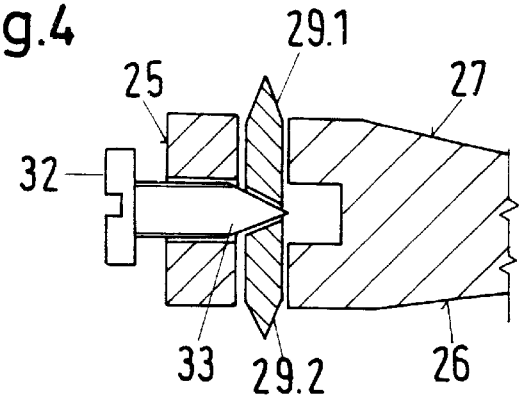
FIG. 4 a schematic representation of an anchoring mechanism in section.

FIG. 4 shows a possibility for realising extendable spike elements 29.1, 29.2. On the rear side the spike elements 29.1, 29. 2 are bevelled wedge-like so that they may be pressed outwardly by the tip 33 of the screw 32. The metallic spike elements 29.1, 29.2 in the inside of the connection element are reliably connected to the protective earth.

Alternatively to a mechanism of the described type also the incorporation of an earthing screw is conceivable, this cutting into a prior drilled hole in the section member.

FIGS. 5*a–c* shows a second embodiment form of the plug. The cable 35 leading to the user is laterally led out of the housing 34. On the front side of the housing 34 projects the snout 36 (in the introduction direction). Similar as in the embodiment example according to FIGS. 2*a–c*, at the side of the snout 36 there are provided two contact pins 38, 39 projecting radially outwards. After introducing the plug into the longitudinal channel they are brought in the introduction direction (i.e. in the direction of the longitudinal axis of the snout 36).

In the region of the contact pins 38, 39 there is provided a spring element 40. It projects elastically sprung in a direction diametrically opposite to the contact pins 38, 39 and has the purpose of pressing the mentioned contact pins 38, 39 onto the leads of the conductor rail. The non rotationally symmetric design of the spring element 40 recognisable in FIG. 5*b*, in the manner of a tab running outwardly in a spiral-shaped manner, leads to the fact that with a 90° rotation of the plug, the spring element can be brought into engagement with the lateral wall of the longitudinal channel, which lies opposite the lateral wall equipped with the current conducting leads.

In the rear, i.e. the region of the snout 36 neighbouring the housing 34—similar as in the example according to FIGS. 2*a–c*—there is formed a collar 41.1, 41.2 for the engagement into a retention flute of the conductor rail. The collar is extended greater in the radial direction parallel to the contact pins 38, 39 than in the radial direction perpendicular thereto.

Figure 6:
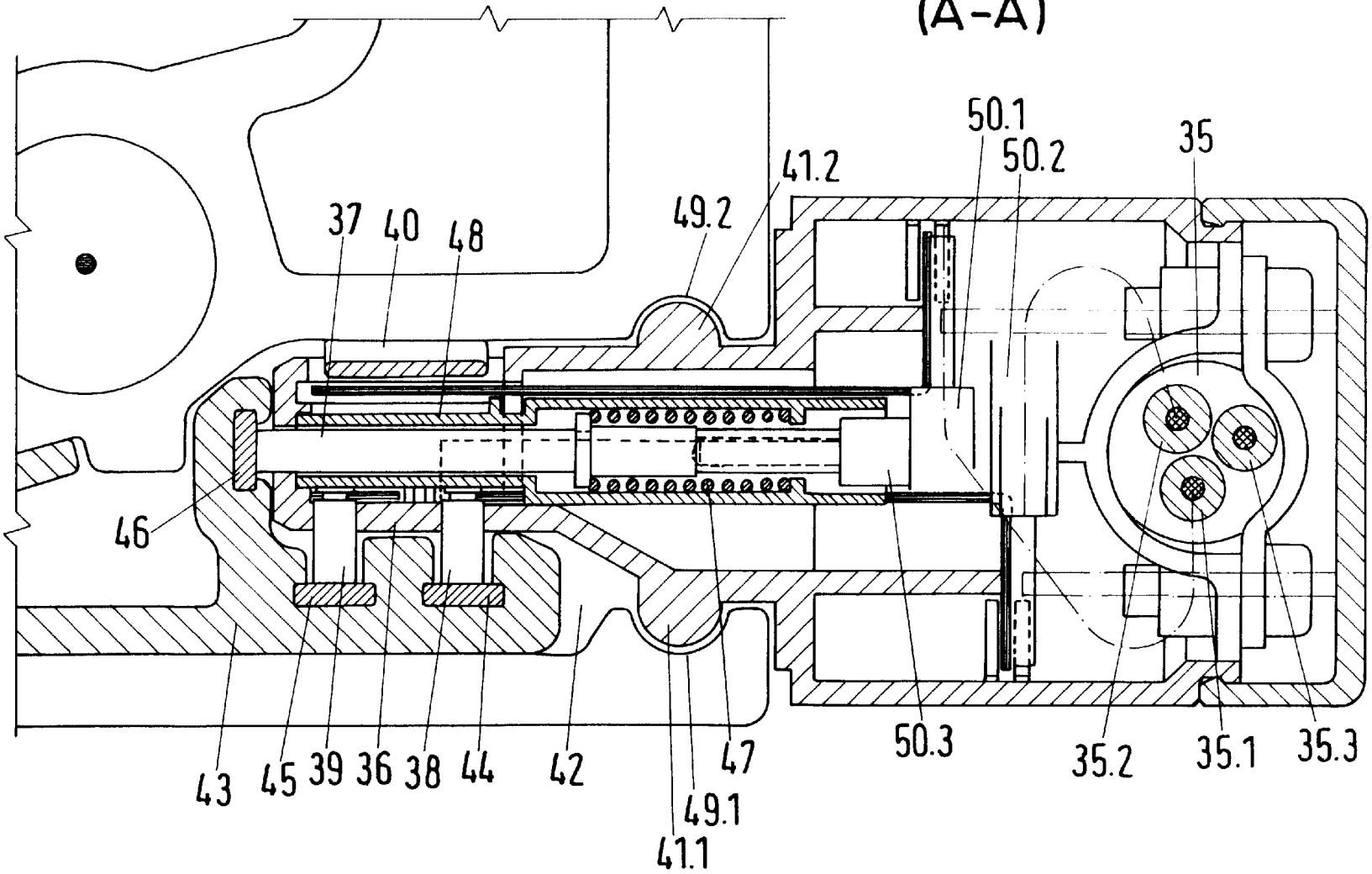
FIG. 6 a schematic representation of the plug shown in FIGS. 5*a–c* in the longitudinal section I—I.

In FIG. 6 a plug according to FIGS. 5*a–c* is applied in a conductor rail. The longitudinal channel 42 of the conductor rail is lined with a plastic element 43 extending in the longitudinal direction of the longitudinal channels 42. The element serves as a member for the current conducting strip leads 44, 45 and the earthing strip lead 46. Whilst the two first mentioned strip leads 44, 45 are arranged next to one another on a lateral wall standing parallel to the introduction direction, the third strip lead 46 is located on a rear side lying opposite to the longitudinal slot. On introduction of the plug the contact pin 37 is thus directly brought onto this third strip lead 46, this being even before the two other contact pins 38, 39 can come into contact with the current conducting strip leads 44, 45 by way of a subsequent rotation of the plug.

As can likewise be recognised from FIG. 6, the contact pin 37 is spring mounted in an axial direction (with respect the snout 36). In the present example, for this purpose, in the rear part of the snout 36 there is provided a compression spring 47 which presses the contact pin 37, displaceably mounted in an insulating tube 48, forwards out of the snout 36. The compression spring may contribute to a good retention of the plug since it equally tensions the plug between the strip lead 46 on the one side and the deepenings of the strip leads 44, 45 on the other side (or the flutes 49.1, 49.2 running on the edge of the longitudinal slot).

Finally it is allusively illustrated in FIG. 6 how the flexes 35.1, 35.2, 35.3 of the cable 35 may be connected to stationary connection jacks 50.1, 50.2, 50.3. The two first mentioned connection jacks 50.1, 50.2 are in connection with the cylindrical contact pins 38, 39 by way of strip leads. The connection jack 50.3 is in connection with the third contact pin 37 via a tubular conductor.

The invention is of course not limited to the described embodiment examples. Thus in place of the double S-section, also a common box section or flat section with a rectangular inner cross section may occur.

The plug shown in FIGS. 2*a–c* has a stationary collar as a retention element. It is however also conceivable to provide a manually operable retention mechanism (e.g. a sprung extending gripper) which may be tensioned in the mentioned flutes.

The member for the electrical leads may have any suitable cross section. If e.g. the longitudinal channel is rectangular, then the member if desired may have a wedge-shaped cross section so that a tapered free space is formed. The member does not also need to be an independent element. It may be formed as an integral component of the section member.

The connection element may be provided at any location of the section member. If there is the possibility of effecting the current supply of the rail from the end face, then the mentioned element may of course be designed entirely differently, since it then does not have to necessarily be accessible through the longitudinal slot. It is of course e.g. quite conceivable that the connection plug is arranged on the end face of the section member. The ends of the conductor rail may be so shaped that several rails may be joined to one another at the end face (and thus create a continuous current supply). Longer conductor rails may then be stuck together according to the building block principle. In this context it is also to be noted that apart from straight section members also curved or branched section members may be made available.

The conductor rail according to the invention is not only suitable for integration in new furniture systems, but also for equipping existing office furniture. For example a horizontal assembly along the rear cover plate of a work table or of a PC piece of furniture would be particularly attractive. Very generally the conductor rail may be applied everywhere where the possibility of a current tapping at any location is desired.

Concluding, it is to be ascertained that by way of the invention there is created a conductor rail system which is particularly suitable for the electrification of furniture. Of course other applications are also possible. These are such applications which demand a flexible, aesthetically pleasing and space-saving solution.

What is claimed is:

1. A busbar comprising:

a profile support sith a rectangular cross section, a lengthwise channel which is accessible via lengthwise solt in the profile support, the lengthwise slot being located on one narrow side of the rectangular cross section, wherein the lengthwise channel is defined by a first side wall and a second side wall which is arranged opposed to the first side wall, the second side wall being oblique with respect to the first side wall;

at least two conductors designed for carrying current in the lengthwise channel which can be placed in contact with a plug anywhere along the length of the lengthwise channel, wherein the indicated at least two conductors are located countersunk in the same one of the first and second side wall of the lengthwise channel, the lengthwise channel having a cross section which continuously tapers from the lengthwise slot towards the rear thereof.

2. The busbar as claimed in claim 1, further comprising:

a second inner wall directly opposite the lengthwise slot, and metallic in order to serve as protective ground; and a first inner wall which is outfitted with electrical conductors, and adjacent the second inner wall.

3. The busbar as claimed in claim 1, further comprising:

a third conductor which is a ground and located on the rear and opposite the lengthwise slot of the channel.

4. The busbar as claimed in claim 1, further comprising:

grooves in the lengthwise channel inside the lengthwise slot to be used as engagement for the locking element of a plug.

5. The busbar as claimed in claim 1, wherein the at least two electrical conductors are embedded in an insulating support, and the profile support is metallic.

6. The busbar as claimed in claim 5, wherein the insulating support is one coherent element of plastic material and the insulating support comprises the at least two current conductors and one ground conductor.

7. The busbar as claimed in claim 5, wherein the insulating support is made as a plastic section which completely covers the first side wall, and covers half the second side wall opposite the first side wall, a forward shifted rear wall being thereby formed.

8. The busbar as claimed in 1, further comprising:

at least one permanently mounted terminal element for power supply.

9. The busbar as claimed in claim 8, wherein the terminal element is completely countersunk in the lengthwise channel and has a plug terminal which discharges in the lengthwise slot.

10. An article of furniture comprising a busbar, the busbar including:

a profile support with a rectangular cross section, a lengthwise channel which is accessible via a lengthwise slot in the profile support, the lengthwise slot being located on one narrow side of the rectangular cross section, the lengthwise channel defined by a first side wall and a second side wall which is arranged opposed to the first side wall, the second side wall being oblique with respect to the first side wall, at least two conductors designed for carrying current in the lengthwise channel which can be placed in contact with a plug anywhere along the length of the lengthwise channel, the at least two conductors are located countersunk in the same one of the first and second side wall of the lengthwise channel, and the lengthwise channel has a cross section which continuously tapers from the lengthwise slot towards the rear thereof.

11. The article of furniture as claimed in claim 10, wherein the busbar has a second inner wall which is metallic in order to server as the protective ground directly opposite the lengthwise slot, and adjacent to a first inner wall outfitted with electrical conductors is.

12. The article of furniture as claimed in claim 10, wherein the busbar has a third conductor which is a ground and is located on the rear of the channel and opposite the lengthwise slot of the channel.

13. The article of furniture as claimed in 10, wherein grooves are provided in the lengthwise channel inside the lengthwise slot to be used as engagement for the locking element of a plug.

14. The article of furniture as claimed in claim 10, further comprising:

at least one permanently mounted terminal element for power supply.

15. The article of furniture as claimed in claim 14, wherein the terminal element is completely countersunk in the lengthwise channel and has a plug terminal which discharges in the lengthwise slot.

16. The article of furniture as claimed in claim 10, wherein the at least two electrical conductors of the busbar are embedded in an insulating support, and the profile support is metallic.

17. The article of furniture as claimed in claim 16, wherein the insulating support is one coherent element of plastic material and comprises the at least two current conductors and one ground conductor.

18. The article of furniture as claimed in claim 16, wherein the insulating support is made as a plastic section which completely covers the first side wall, and half covers the second side wall opposite the first side wall, a forward shifted rear wall being thereby formed.

19. The article of furniture as claimed in claim 16, wherein the insulating support is one coherent element of plastic material and the insulating support comprises at least two current conductors and one ground conductor.

20. The article of furniture as claimed in claim 19, wherein the insulating support is made as a plastic section which completely covers the first side wall, but conversely half covers the second side wall opposite this first side wall, a forward shifted rear wall being formed.

* * * * *

UNITED STATES PATENT AND TRADEMARK OFFICE

CERTIFICATE OF CORRECTION

PATENT NO. : 6,290,516 B1
DATED : September 18, 2001
INVENTOR(S) : Andre Gerber

It is certified that error appears in the above-identified patent and that said Letters Patent is hereby corrected as shown below:

Title page,
Item [73], Assignee, please correct the assignee's name and address from "USM U. Scharer Sohne AG, Munsingen (CH)" to -- USM Holding AG, Gumligen (CH) --.

Signed and Sealed this

Twenty-third Day of April, 2002

*Attest:*

*Attesting Officer*

JAMES E. ROGAN
*Director of the United States Patent and Trademark Office*